United States Patent [19]

Breslow et al.

[11] 4,234,181

[45] Nov. 18, 1980

[54] ROUND-ABOUT GAME APPARATUS

[75] Inventors: Jeffrey D. Breslow, Highland Park; Eugene Jaworski, Park Ridge, both of Ill.

[73] Assignee: Marvin Glass & Associates, Chicago, Ill.

[21] Appl. No.: 944,252

[22] Filed: Sep. 21, 1978

[51] Int. Cl.[3] ..... A63F 9/00

[52] U.S. Cl. ..... 273/1 R; 273/DIG. 26

[58] Field of Search ..... 273/1 R, 1 E, 1 M, DIG. 26

[56] References Cited

U.S. PATENT DOCUMENTS

| | | | |
|---|---|---|---|
| 2,148,828 | 2/1939 | Myers | 273/1 E UX |
| 2,917,310 | 12/1959 | Durrell | 273/1 E X |
| 3,589,719 | 6/1971 | Glass et al. | 273/1 E X |
| 3,754,759 | 8/1973 | Breslow et al. | 273/1 R |
| 3,819,178 | 6/1974 | Ochi | 273/1 E |
| 3,825,256 | 7/1974 | Ochi | 273/1 E |
| 3,841,629 | 10/1974 | Barlow | 273/1 R |
| 3,865,367 | 2/1975 | Breslow et al. | 273/1 E |

FOREIGN PATENT DOCUMENTS

| | | | |
|---|---|---|---|
| 694538 | 9/1964 | Canada | 273/1 E |

*Primary Examiner*—Paul E. Shapiro

*Attorney, Agent, or Firm*—Mason, Kolehmainen, Rathburn & Wyss

[57] ABSTRACT

A round-about game apparatus for use by a plurality of players requires timely actuation of the playing pieces to circumvent score reduction. The game apparatus generally includes a housing having a platform, a rotatably mounted striking element and a drive mechanism for moving the striking element in a circular path. A plurality of playing pieces are arranged around the circular path of travel of the striking element such that the playing pieces will be struck by the rotating element unless timely actuated by the associated player of the game. The playing pieces are selectively actuated so as to move out of the path of travel of the striking element to avoid a score reduction. After a predetermined number of hits, a particular player is eliminated from the play of the game and the game continues until all but one of the players remains, that player being declared the winner.

13 Claims, 7 Drawing Figures

ROUND-ABOUT GAME APPARATUS

BACKGROUND OF THE INVENTION

1. Field of the Invention

This invention relates to amusement devices and more particularly to a round-about game wherein the object is for the players of the game to actuate their playing pieces in an attempt to avoid being hit by a moving striking element.

2. Description of the Prior Art

Round-about type games have enjoyed success and popularity throughout the years. These toys usually consist of a figure traveling in a circuitous path on a platform. The object of many of these prior art games is to attempt to strike a moving target or hit a stationary target while moving in relation thereto. An example of such a game is shown in U.S. Pat. No. 3,754,759.

SUMMARY OF THE INVENTION

The present invention provides a round-about game apparatus, for use by a plurality of players, which requires timely actuation of the playing pieces to evade a rotatably mounted striking element. The game apparatus generally includes a housing having a platform for mounting the striking element and a plurality of playing pieces positioned about the path of travel of the striking element such that the playing pieces will be struck by the rotating element unless timely actuated by the associated player of the game. The playing pieces are selectively actuated so as to move out of the path of travel of the striking element to avoid a score reduction. After a predetermined number of hits, a particular player is eliminated from the play of the game and the game continues until all but one of the players remains, that player being declared the winner.

Figure 1:
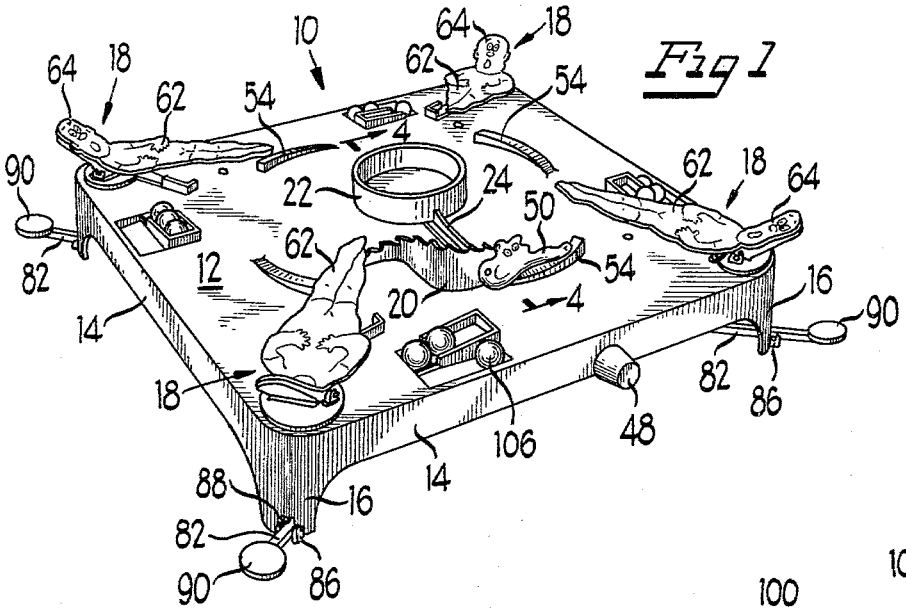
FIG. 1 is a perspective view of a game apparatus made in accordance with the concepts of the present invention.

While this invention is susceptible of embodiment in many different forms, there is shown in the drawings and will hereinafter be described in detail, a specific embodiment therefore, with the understanding that the present disclosure is to be considered an exemplification of the principles of the invention and is not intended to limit the invention to the embodiment illustrated.

DESCRIPTION OF THE PREFERRED EMBODIMENT

A game apparatus made in accordance with the concepts of the present invention is shown in FIG. 1 and generally designated 10. The game apparatus 10 is based on a beach or swimming theme wherein a plurality of lounging bathers are successively and repeatedly attacked by an alligator. The object of the game is for the players to timely actuate their playing pieces so that they are not "caught" by the creature.

Figure 4:
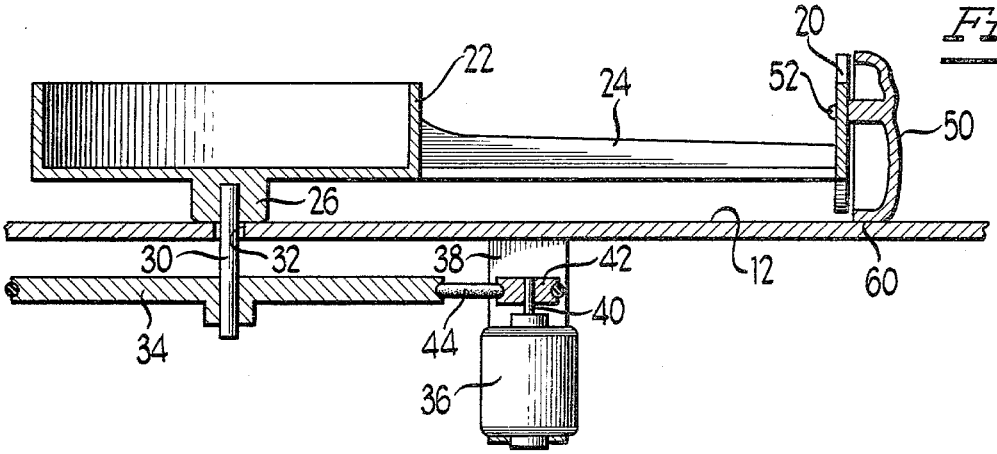
FIG. 4 is another vertical section taken generally along line 4—4 of FIG. 1.

More particularly, referring to FIG. 1, the game apparatus includes a generally flat platform portion 12 which is circumscribed by a depending skirt 14 and a plurality of legs 16. In the preferred embodiment, four playing pieces generally designated 18 are mounted at each corner of the platform 12 and generally radially directed relative to the center of the platform. A moving striking element 20 in the form of an alligator is secured to a central rotatable hub 22 by a radial connecting link 24. As shown in FIG. 4, the hub 22 includes a reduced diameter journal portion 26 which is connected to a vertical shaft 30. The shaft extends through an aperture 32 in the center of the platform 12 and is connected to a large pulley 34 mounted below the platform. Drive means in the form of a small electric motor 36 is secured to the underside of the platform 12 by a frame 38 with the motor shaft 40 extending generally vertically upwardly. A small drive pulley 42 is mounted on the end of the shaft and drivingly connected to the larger pulley 34 by a flexible belt 44. An on-off switch 48 (FIG. 1) mounted on the skirt 14 permits the motor to be selectively actuated. Power for the motor can be derived either from a portable source, such as a pair of batteries, or by a conventional current to a wall socket. The motor 36 thus causes the alligator 20 to rotate in a circular path about the hub 22 at a moderate rate of speed because of the reduction between the pulleys 42 and 34.

Figure 5:
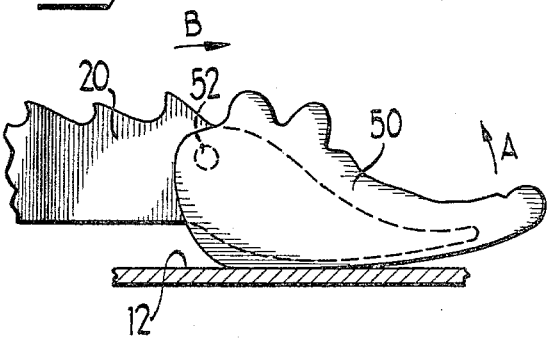
FIGS. 5 and 6 show two relative positions of a movable element mounted on the leading edge of the striking element.
Figure 6:
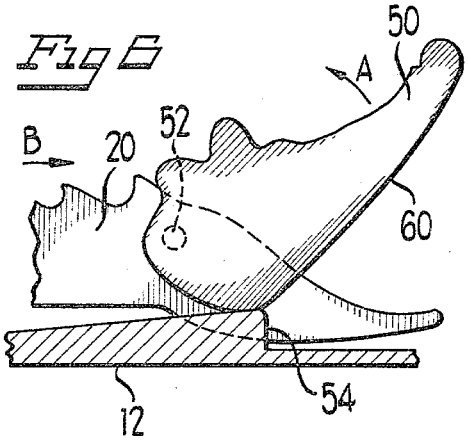

Referring to FIGS. 5 and 6, the alligator 20 includes a pivotal head portion 50 secured to the body portion by a pivot pin 52. A plurality of generally triangular cam surfaces 54 are mounted in the circular path of travel of the head portion 50. Referring to FIG. 6, as the head 50 engages a cam 54, the bottom surface 60 thereof slides up the cam surface causing the head portion 50 to pivot upwardly, in the direction of arrow A, as the alligator moves in the direction indicated by arrow B. The cam surfaces 54 are located inbetween each of the playing pieces 18 so as to open the "jaws" of the alligator 20 just prior to reaching the playing piece.

Each of the playing pieces 18 is generally in the figure of a two-dimensional figure 62 with its feet directed generally radially inwardly toward the center of the hub 22. Each playing piece includes a head portion 64 which is canted upwardly from the generally planar torso portion and provided with indicia representative of a shocked appearance for the figure as if the player had just seen a charging, open mouthed alligator.

Figure 2:
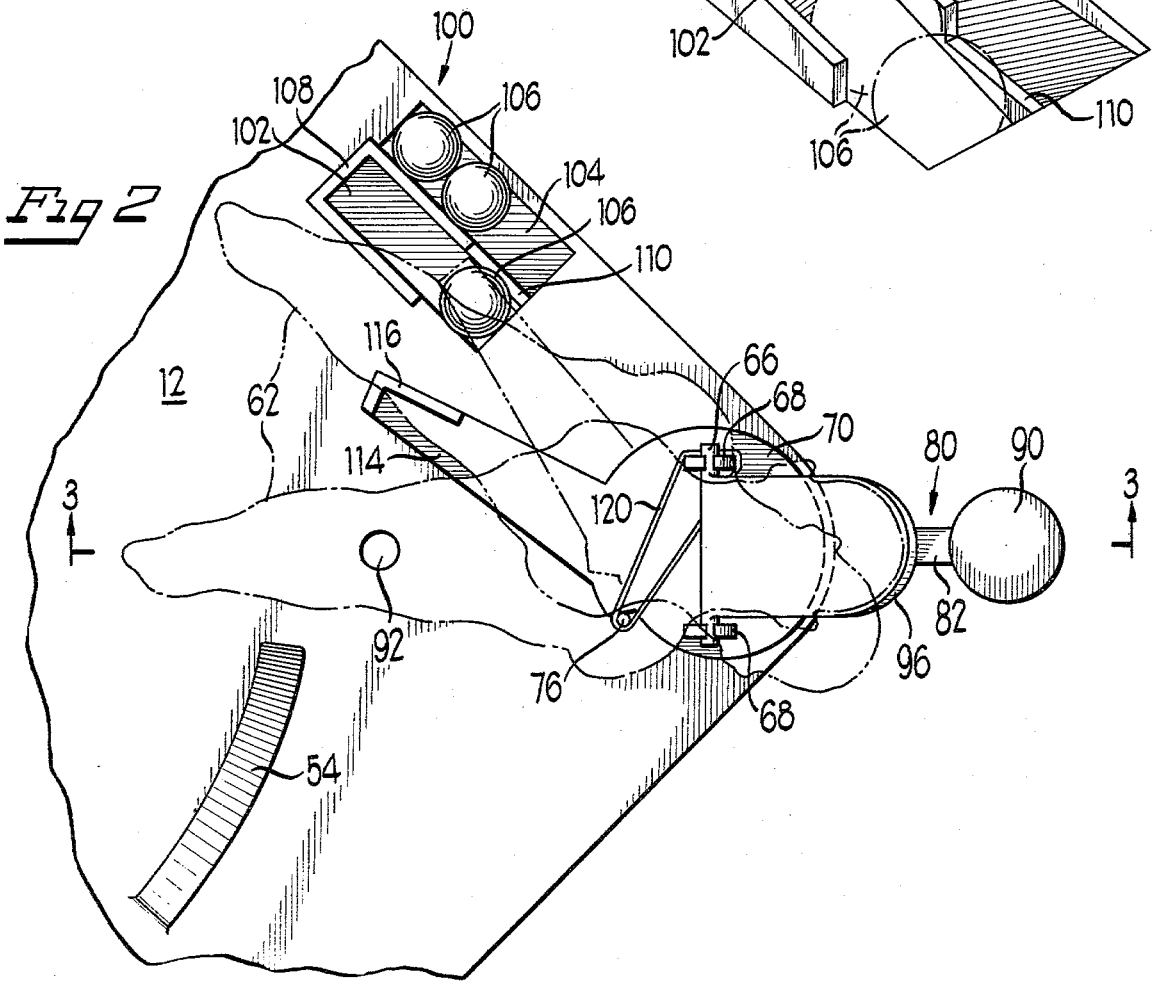
FIG. 2 is a fragmentary, top plan view, on an enlarged scale, showing one of the playing pieces of the game apparatus of FIG. 1.
Figure 3:
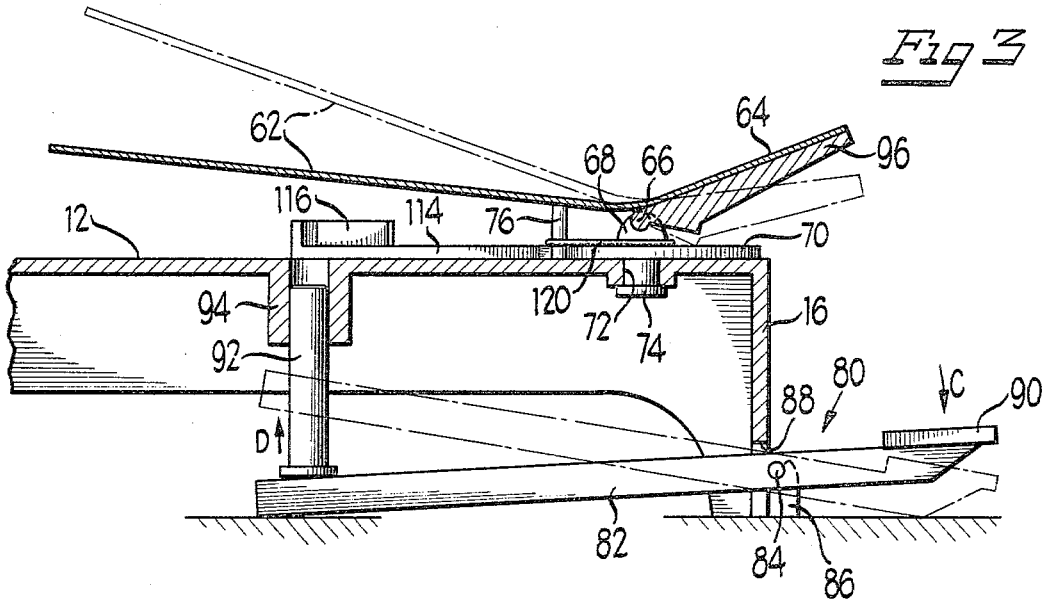
FIG. 3 is a vertical section taken generally along line 3—3 of FIG. 2.

At the juncture between the head and the torso portion of each of the playing pieces 18, a shaft 66 is provided on the underside of the figure for mounting the figure for pivotal movement in a generally vertical plane. The shaft 62 is pivotally mounted by a pair of journals 68 as seen in FIGS. 2 and 3. The journals 68 are themselves mounted to a rotatable platform 70 secured within an appropriate aperture 72 by an enlarged head 74 on the bottom of the platform 12. A support pin 76 on the platform 12 adjacent the rotatable platform 70 supports the playing pieces 18 in a slightly canted position as shown in cross-section by the solid lines in FIG. 3.

Each of the players has an actuator, generally designated 80, adjacent his associated playing piece for effecting movement of his playing piece out of danger, away from the alligator. More specifically, the actuator includes an elongated arm 82 pivotally mounted by a shaft 84 in a journal 86 mounted at each corner of the platform 12. The arms 82 extend through apertures 88 in each of the legs and include a finger or pushbutton 90 at its outermost extremity for striking by the players of the game. A reciprocating pin 92 is mounted within a journal 94 on the underside of the platform 12 at the inner end of each arm 82 (FIG. 3). As the actuator 80 is struck by a player's finger in the direction of arrow C, the inner end of the arm 82 moves upwardly to the position as shown in phantom so that the pin 92 moves in the direction of arrow D through the platform to strike the playing piece 62 and cause it to move upwardly to the angle as indicated by the phantom lines in FIG. 3. The pin 92 is not long enough to hold the playing piece out of reach of the alligator jaw 50. Therefore, the actuator 80 must be sharply and timely actuated to cause the momentum of the playing piece to travel to a height out of reach of the jaw 50.

A depending flange portion 96 on the underside of the head 64 of each playing piece limits the upward travel of the torso portion 62 of the playing piece and will cause the playing piece to snap back down into the jaws if the actuator 80 is struck too hard. Therefore, during the play of the game, each player attempts to timely actuate his assigned actuator 80 so that as the alligator 20 approaches with its jaws open, as seen in FIG. 6, the lower portion or feet of the torso is raised upwardly to avoid being "caught" by the alligator 20.

Figure 7:
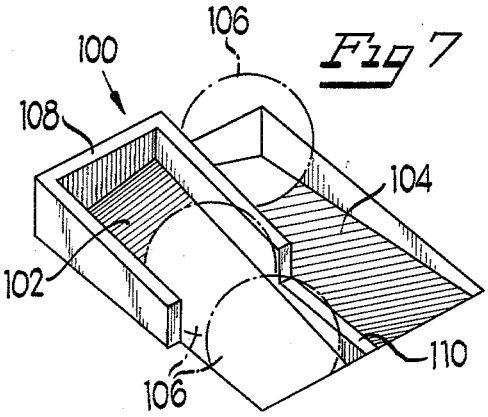
FIG. 7 is an enlarged perspective view of the scoring device utilized with the present invention.

A scorekeeper or indicator, generally designated 100, is provided as an integral part of the game in order to assist the players in keeping track of those unsuccessful attempts by various players to escape being caught. The scorekeeper includes a pair of oppositely directed chutes or surfaces which are preferably integrally molded in the upper surface of the platform 12. One surface 102 serves as a starting or holding area for up to three suitably shaped balls 106 and includes an upwardly extending generally U-shaped flange 108 to maintain the three balls on the holding chute 102. A cutout 110 at the bottom of the flange 108 defines a small rib over which an adjacent ball may easily be bumped if hit on the side opposite the rib onto the lower chute 104 whereafter it rolls down the chute to the position of the one ball as shown in FIG. 7. Thus, during the play of the game, the three balls 106 are successively bumped onto the lower chute when a player fails to elude the rotating alligator.

More specifically, the rotating platform 70 includes a laterally extending flange 114 which extends generally at an angle relative to the torso portion as shown in FIG. 2. The flange 114 includes an upwardly directed L-shaped flange portion 116 which travels in an arcuate path as the platform 70 rotates into contact with a ball 106 at the bottom of the holding ramp 102. Thus, as the open jaws of the alligator engage the bottom of the torso of the playing pieces, the figure 18 is caused to pivot through an arc as shown between the two phantom positions of FIG. 2 by rotating the platform 70. Concurrent with this movement, the flange 114 contacts one of the balls 106 at the lower edge of the ramp moving that ball over the rib 110 into the second ramp 104 indicating that that player has failed to evade the alligator. In the scheme of play as shown by the present form of the invention, where three balls can be stationed in the holding ramp, the player is allowed three failures in his evasive action before he is before he is eliminated from the game. A biasing means, in the form of a rubberband 120 between the post 76 and the journal 68 returns the platform 70 to its initial position. The post 76 serves as a stop upon contact with a notch on the flange 114.

Therefore, as a player develops skill and coordination with the game apparatus of the present invention, he will become more successful in his evasive attempts by timely actuation of the actuator 80. The scheme of play of the game continues until all of the players except for one have lost their three balls, in which case the remaining player is declared the winner. Many modifications in the play of the game are possible. For example, a highly skilled player, or an adult playing with a child, may be handicapped by one or two balls so as to provide a more entertaining and fair game between various players.

The foregoing detailed description has been given for clearness of understanding only and no unnecessary limitations should be understood therefrom as some modifications will be obvious to those skilled in the art.

We claim:

1. A round-about game apparatus, comprising:

a housing having a platform defining a playing surface;

a striking element mounted on the platform for movement in a predetermined path of travel including drive means for moving the element along said path;

a plurality of playing pieces mounted on the platform in a position with at least a portion of the playing piece lying in a coincident path with the path of travel of said striking element, said playing pieces being mounted for selective movement thereof out of said coincident path of travel; and a selectively operable, manually variable, actuator associated with each playing piece for variably moving the portion of the playing piece depending on the intensity of manual operation of said actuator from the coincident path of travel with the striking element, upon timely actuation by the player of the game.

2. The game apparatus of claim 1 including rebounding means for impacting said playing pieces when they are moved beyond a predetermined set limit and for causing said playing pieces to rebound back to their original position.

3. A round-about game apparatus, comprising:

a housing having a platform defining a playing surface;

a striking element mounted on the platform for movement in a predetermined path of travel;

selectively operable drive means for moving said striking element through its predetermined path;

a plurality of playing pieces mounted on the platform in a position with at least a portion of the playing piece lying in a coincident path with the path of travel of said striking element;

a selectively operable actuator associated with each playing piece for moving the portion of the playing piece away from the coincident path of travel with the striking element upon timely actuation thereof by a player of the game;

each of the playing pieces being pivotally mounted for movement about a horizontal axis in response to operation of the associated playing piece actuator by the player of the game for movement out of said coincident path of travel; and a slidably mounted, vertically movable contact pin engageable by one of the actuators for movement upwardly into engagement with the playing piece upon selective operation of said actuator.

4. The game apparatus of claim 3 including a rocker arm having a player depressible end and an opposite end engageable with said contact pin for moving the contact pin into engagement with the playing piece upon actuation of the player depressible end.

5. A round-about game apparatus, comprising:

a housing having a platform defining a playing surface;

a striking element rotatably mounted on the platform for movement in a predetermined path of travel;

a plurality of playing pieces mounted on the platform in a position with at least a portion of the playing piece lying in a coincident path with the path of travel of said striking element;

a selectively operable actuator associated with each playing piece for moving the portion of the playing piece from the coincident path of travel with the striking element upon timely actuation by the player of the game; and means for mounting the playing pieces for pivotal movement out of the coincident path of travel with the striking element upon contact by said striking element.

6. The game apparatus of claim 5 including biasing means to maintain said playing piece in a normal position with a portion of the playing piece in a coincident path of travel with the striking element.

7. The game apparatus of claim 6 including scoring means associated with the playing pieces, said scoring means being actuated upon pivotal movement of the playing pieces after being struck by said striking element.

8. A round-about game apparatus, comprising:

a housing having a platform defining a playing surface;

a striking element mounted on the platform for movement in a predetermined path of travel;

at least one playing piece mounted on the platform in a position with at least a portion of the playing piece lying in a coincident path with the path of travel of said striking element;

a selectively operable actuator associated with each playing piece for moving the portion of the playing piece from the coincident path of travel with the striking element, upon timely actuation by the player of the game; and cam means on the playing surface operatively associated with the striking element for directing a portion of the striking element into a path coincident with a portion of said playing pieces.

9. The game apparatus of claim 18 wherein said striking element comprises a pivoted portion engageable with said cam surface for pivotal movement into a path of travel coincident with said playing piece.

10. The game apparatus of claim 9 wherein said striking element is in the form of an alligator with said pivoted portion representing the upper jaw of the alligator.

11. The game apparatus of claim 10 including scoring means associated with said playing pieces, said scoring means being actuated by said striking element.

12. The game apparatus of claim 11 wherein said scoring means includes a counter associated with each of the playing pieces and means conjointly mounted with said playing pieces to operate the scoring means.

13. A scoring means for a game apparatus, comprising:

an actuatable scoring device;

a plurality of playing pieces operatively associated therewith to actuate said scoring means, said playing pieces being movable between a normal position and a scoring position;

biasing means for urging said playing pieces to their normal position;

a striking element movably mounted on the game apparatus for contacting the playing pieces while in the normal position for movement to the scoring position; and a plurality of selectively operable actuators associated with the playing pieces for moving the playing pieces away from said normal position to avoid contact by said striking element and prevent actuation of the scoring device.

* * * * *